US010337291B1

(12) United States Patent
Brown et al.

(10) Patent No.: US 10,337,291 B1
(45) Date of Patent: Jul. 2, 2019

(54) APPARATUS AND METHOD FOR MORE EFFICIENTLY SCANNING PRODUCTION TUBING THAT INCORPORATES A CABLE SECURED THERETO

(71) Applicants: Jeffrey J. Brown, Enid, OK (US); Trevor D. Willey, Mustang, OK (US); Justin C. Weaver, Enid, OK (US)

(72) Inventors: Jeffrey J. Brown, Enid, OK (US); Trevor D. Willey, Mustang, OK (US); Justin C. Weaver, Enid, OK (US)

( * ) Notice: Subject to any disclaimer, the term of this patent is extended or adjusted under 35 U.S.C. 154(b) by 0 days.

(21) Appl. No.: 16/051,046

(22) Filed: Jul. 31, 2018

Related U.S. Application Data

(60) Provisional application No. 62/669,809, filed on May 10, 2018.

(51) Int. Cl.

| | |
|---|---|
| ***E21B 41/00*** | (2006.01) |
| ***E21B 19/00*** | (2006.01) |
| *E21B 15/00* | (2006.01) |
| *E21B 33/03* | (2006.01) |

(52) U.S. Cl.
CPC ..... *E21B 41/00* (2013.01); *E21B 19/00* (2013.01); *E21B 15/00* (2013.01); *E21B 33/03* (2013.01)

(58) Field of Classification Search
CPC . E21B 7/02; E21B 7/023; E21B 7/026; E21B 41/00; E21B 19/00; E21B 33/03; E21B 15/00
See application file for complete search history.

(56) References Cited

U.S. PATENT DOCUMENTS

| | | | | |
|---|---|---|---|---|
| 5,202,680 | A * | 4/1993 | Savage | E21B 17/006 175/40 |
| 7,469,749 | B2 * | 12/2008 | Folk | E21B 7/02 166/379 |
| 2007/0158079 | A1 * | 7/2007 | Webre | E21B 17/026 166/380 |
| 2008/0037368 | A1 * | 2/2008 | Newman | E21B 17/00 367/69 |

* cited by examiner

*Primary Examiner* — Robert E Fuller
(74) *Attorney, Agent, or Firm* — Hall Estill Law Firm

(57) ABSTRACT

A platform apparatus positionable close to a surface element to allow an operator to access production tubing being withdrawn from the surface element. The platform apparatus can be positioned in close proximity to a surface element of a well to permit an operator access to production tubing and cable secured to the production tubing. The cable can be separated from the production tubing. The production tubing can be scanned with an electronic scanning device after the cable has been separated from the production tubing as the production tubing is being removed from the well. The platform apparatus can be positioned in close proximity to a surface element of a well being serviced by a pole unit to permit an operator access to production tubing. The production tubing can be scanned with an electronic scanning device as the production tubing is being removed from the well.

17 Claims, 7 Drawing Sheets

APPARATUS AND METHOD FOR MORE EFFICIENTLY SCANNING PRODUCTION TUBING THAT INCORPORATES A CABLE SECURED THERETO

CROSS-REFERENCE TO RELATED APPLICATIONS

The present application is a conversion of U.S. Provisional Application having U.S. Ser. No. 62/669,809, filed May 10, 2018, which claims the benefit under 35 U.S.C. 119(e). The disclosure of which is hereby expressly incorporated herein by reference.

STATEMENT REGARDING FEDERALLY SPONSORED RESEARCH OR DEVELOPMENT

Not applicable.

BACKGROUND OF THE DISCLOSURE

1. Field of the Disclosure

The present disclosure relates to an apparatus and method for more efficiently scanning or inspecting production tubing that uses a cable secured thereto during an oil and gas operation. The cable can be a power cable, a data cable, or a capillary string. For example, the apparatus and method disclosed herein makes scanning the production tubing used with an electrical submersible pump (ESP) in oil and gas operations, which requires a power cable, more efficient.

2. Description of the Related Art

As an example of oil and gas operations that incorporate a cable secured to production tubing, electric submersible pump systems comprise both downhole and surface components to facilitate the operation ESPs. A downhole submersible motor is used to provide power to the ESP. Power is provided from the surface to the motor via an electric cable designed for downhole environments. To limit cable movement in the well and to support its weight, the cable is banded or clamped to the production tubing.

Production tubing can be electronically scanned by various pieces of equipment when it is removed from the well to determine the condition of the production tubing. Production tubing with the cable, which is used to provide power from the surface to the ESP, secured thereto, cannot be successfully scanned because the electric cable corrupts the functionality of the scanning equipment.

Typically, the production tubing and cable has to be removed from the wellbore, the cable has to be removed from the production tubing and then the production tubing ran back down in the well and the production tubing is scanned in a separate operation than the operation to remove the production tubing and cable from the wellbore.

Accordingly, there is a need for an apparatus and method that can facilitate scanning or inspection of the production tubing and separating the production tubing from the cable during the operation that removes the production tubing from the wellbore.

SUMMARY OF THE DISCLOSURE

The present disclosure is directed toward a platform apparatus positionable close to a surface element to allow an operator to access production tubing being withdrawn from the surface element.

The present disclosure is also directed toward a method of using the platform apparatus. The platform apparatus can be positioned in close proximity to a surface element of a well to permit an operator access to production tubing and cable secured to the production tubing. The cable can then be separated from the production tubing. The production tubing can then be scanned with an electronic scanning device after the cable has been separated from the production tubing as the production tubing is being removed from the well.

The present disclosure can be directed toward another method. The method includes positioning a platform apparatus in close proximity to a surface element of a well being serviced by a pole unit to permit an operator access to production tubing. The method also includes the step of scanning the production tubing with an electronic scanning device as the production tubing is being removed from the well.

DETAILED DESCRIPTION OF THE DISCLOSURE

Figure 1:
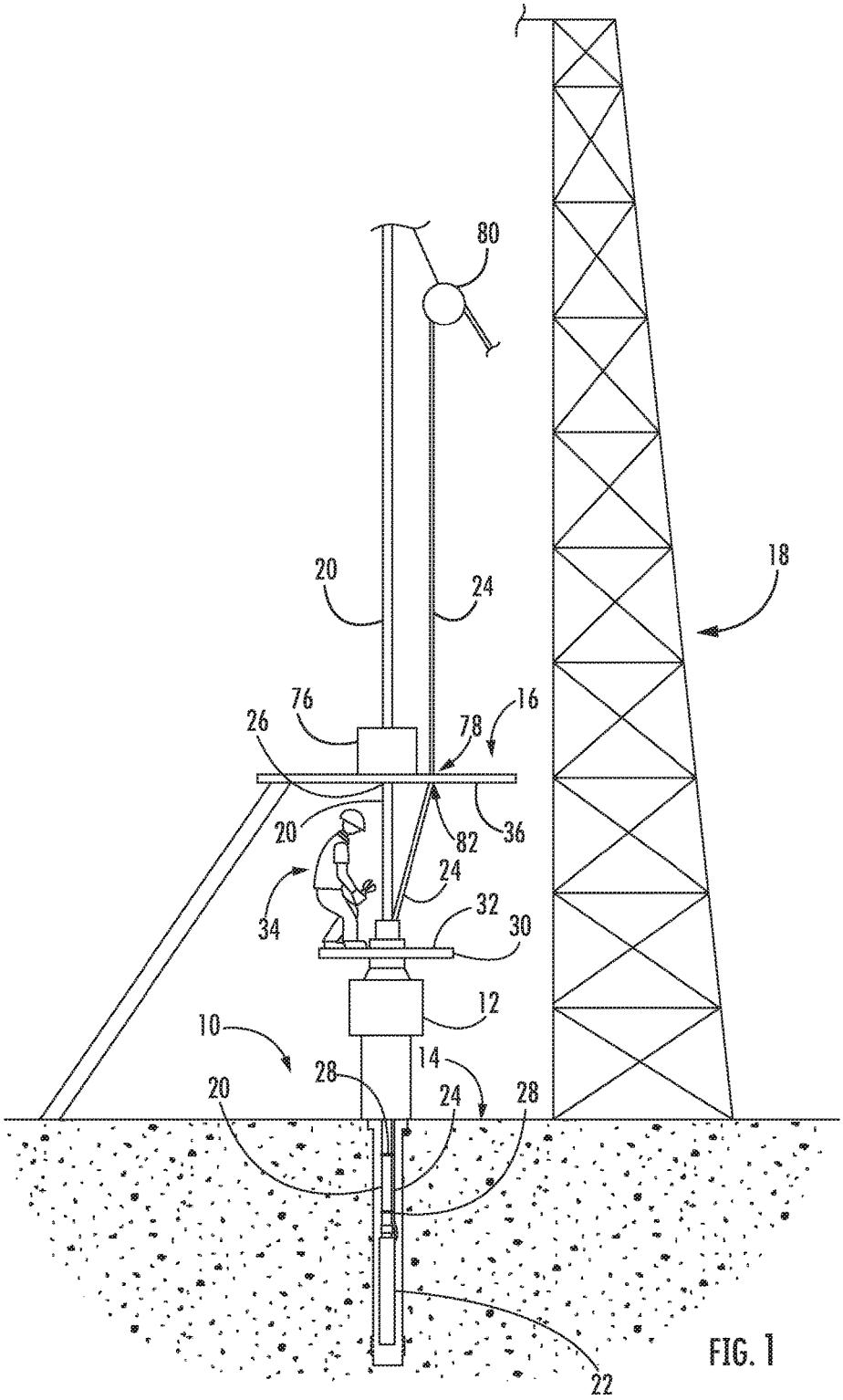
FIG. 1 is a side elevation view of an oil and gas well incorporating a platform apparatus constructed in accordance with the present disclosure.
Figure 2:
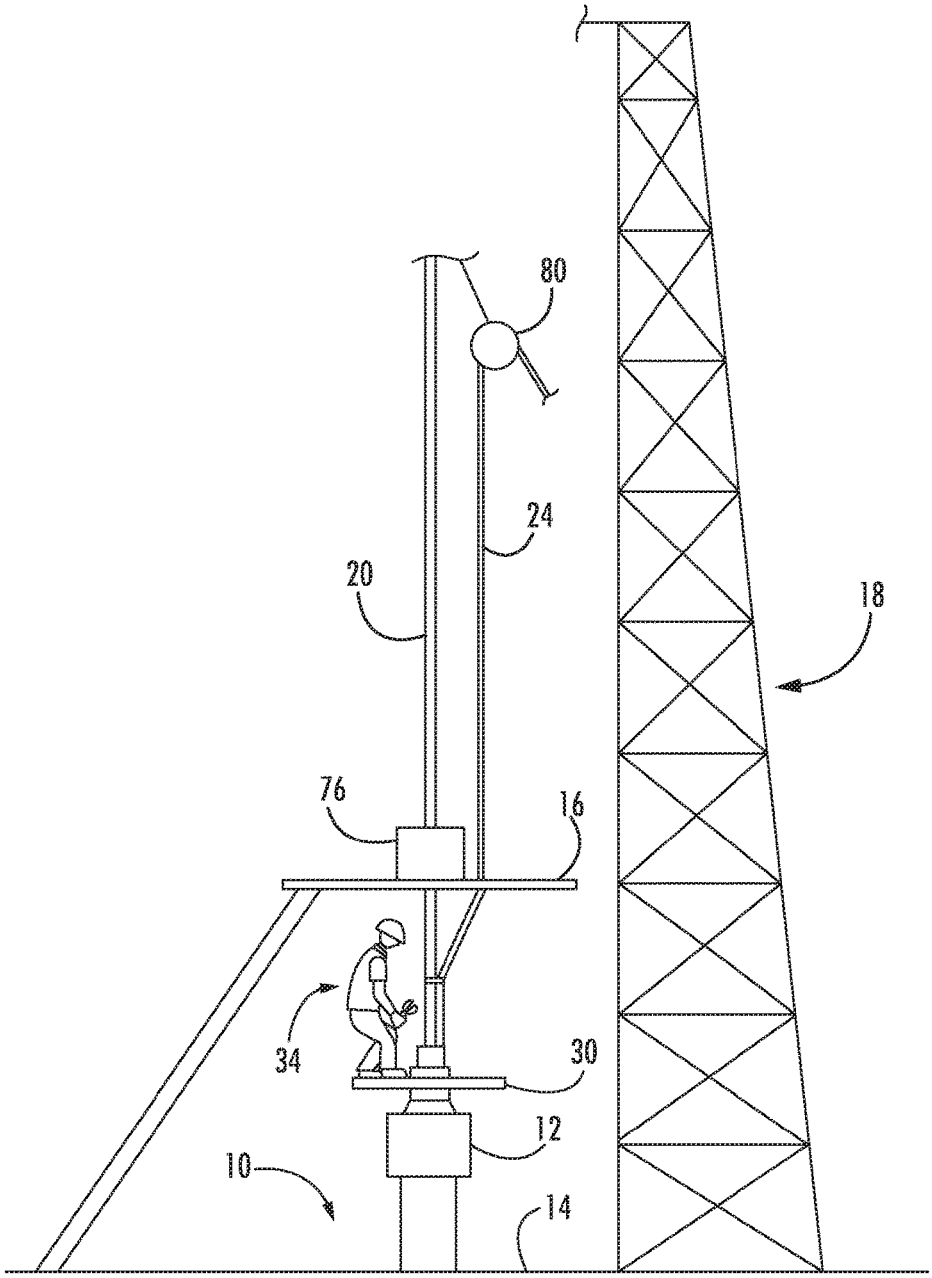
FIG. 2 is side elevation view of an above ground portion of an oil and gas well incorporating the platform apparatus constructed in accordance with the present disclosure.
Figure 3:
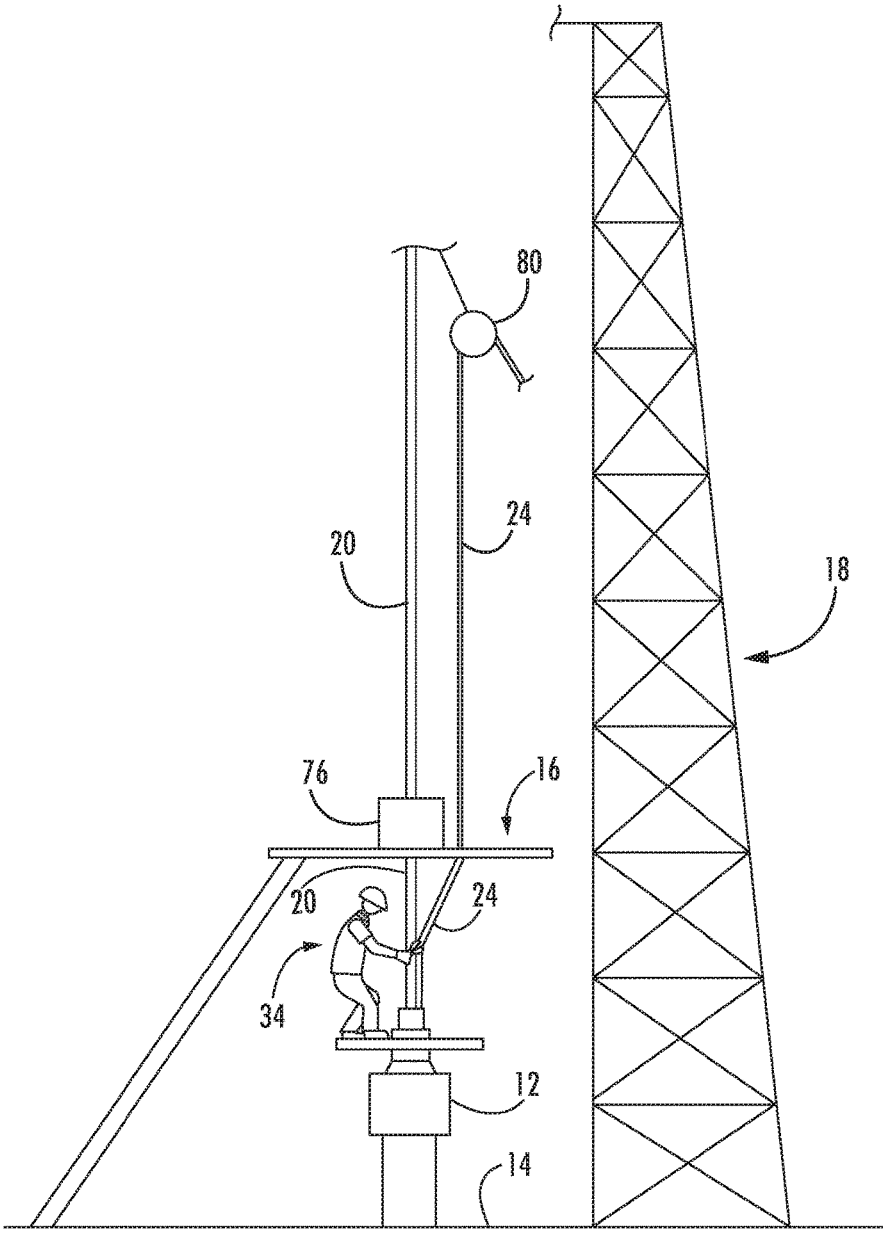
FIG. 3 is another side elevation view of an above ground portion of an oil and gas well incorporating the platform apparatus constructed in accordance with the present disclosure.

Referring now to FIGS. 1-3, shown therein is a well 10 having a surface element 12, such as a blowout preventer or wellhead, placed at the surface 14 of the well 10 and below an oil rig platform 16 of an oil rig 18. Production tubing 20 can be withdrawn from the well 10 through the surface element 12 and through the oil rig platform 16 of the oil rig 18. In some instances, an oil rig platform 16 is not used when performing oil and gas operations that involve a downhole tool 22 that requires a cable 24 be secured to the production tubing 20. The oil rig platform 16 is typically disposed above surface element 12 and includes an opening 26 disposed therein to allow the production tubing 20 to pass therethrough. The cable 24 can be a power cable, a data cable, or a capillary string depending on the specific oil and gas operation being performed.

In an exemplary embodiment, when an electrical submersible pump (ESP) is used as the downhole tool 22 in an oil and gas operation, the cable 24 is an electric power cable to provide power to the ESP from the surface 14 of the well 10. The cable 24 is banded or clamped to the production tubing 20 via securing devices 28. It should be understood that the cable 24 can be secured to the production tubing 20 in many oil and gas operations and discussions regarding ESPs herein are only provided as an exemplary embodiment.

The present disclosure is directed toward a platform apparatus 30 and method used to make scanning and inspection of production tubing 20 that has the cable 24 secured thereto for oil and gas operations more efficient. The platform apparatus 30 can include a surface element platform 32 disposed in close proximity to the surface element 12 so that an operator 34 can have access to the production tubing 20 and the cable 24 secured thereto as the production tubing 20 is withdrawn from the well 10. In some exemplary embodiments, the surface element platform 32 can be supported by the surface element 12, attached to the surface element 12, or suspended from an underside portion 36 of the oil rig platform 16. In another exemplary embodiment, the surface element platform 32 can be secured to a vehicle and positioned in close proximity to the surface element 12 via the vehicle. In another embodiment, the surface element platform 32 can be positioned in close proximity to the surface element 12 via mechanical or hydraulic means. In another more specific embodiment, the surface element platform 32 can be bolted to the surface element 12.

Figure 4:
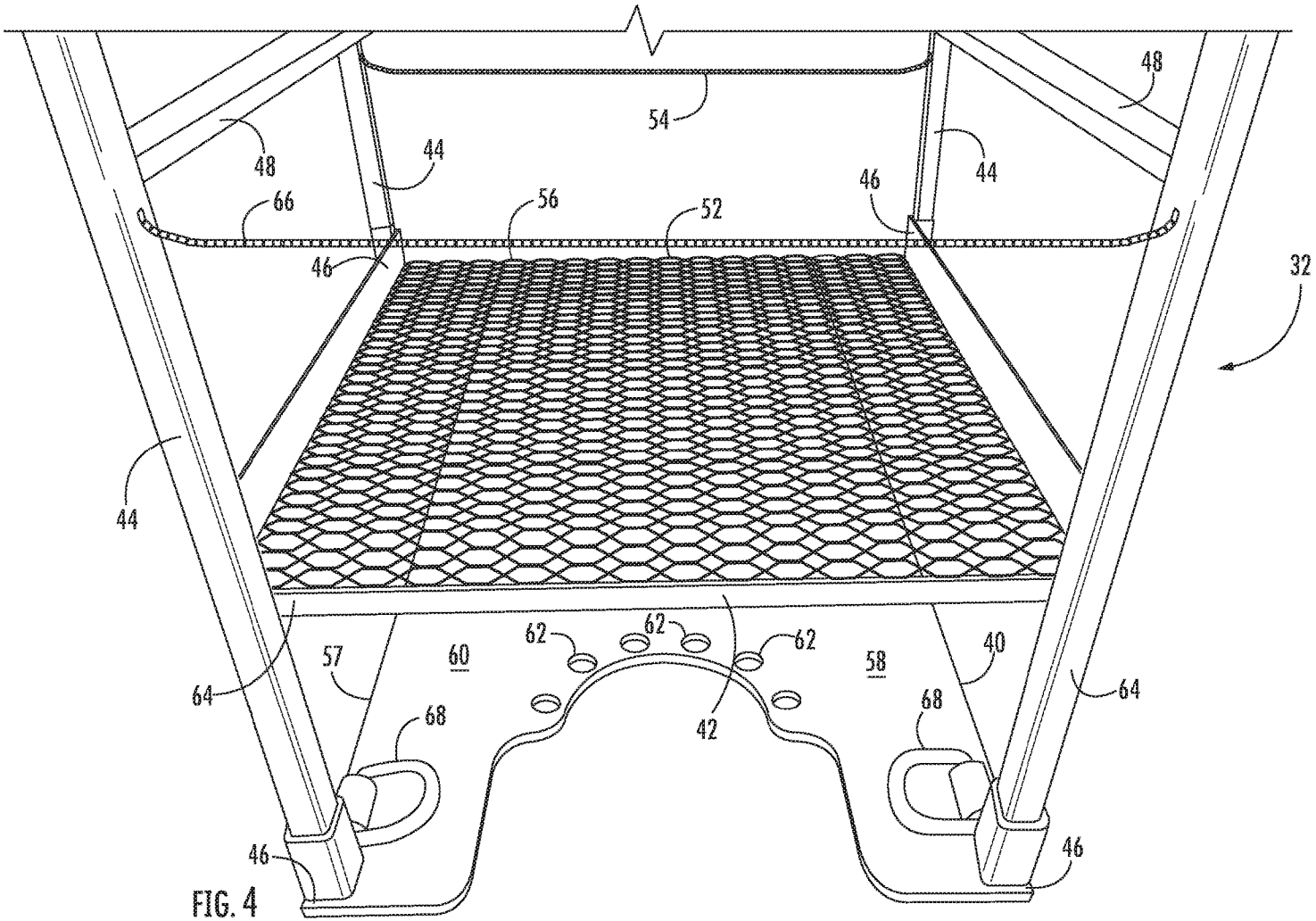
FIG. 4 is a perspective view of one embodiment of a surface element platform constructed in accordance with the present disclosure.

In one embodiment shown in more detail in FIG. 4, the surface element platform 32 includes a platform portion 38 for supporting the operator 34 and a securing portion 40 for attaching the surface element platform 32 to the surface element 12. The securing portion 40 can extend from a first side 42 of the platform portion 38 of the surface element platform 32. The surface element platform 32 can have posts 44 that extend up from corners 46 of the platform portion 38 of the surface element platform 32. The surface element platform 32 can also include guide rails 48 that extend from the posts 44 on the first side 42 of the platform portion 38 and extend from the posts 44 on a second side 52 of the platform portion 38. The surface element platform 32 can also include a chain 54 or chains 54 that can extend from the posts 44 on a back side 56 of the platform portion 38 to act as a security barrier for the operator 34.

The securing portion 40 can be a u-shaped plate 57 and have a first leg 58, and a second leg 60 that include openings 62 for use in securing the surface element platform 32 to the surface element 12. The securing portion 40 can also include posts 64 extending from the first and second legs 58 and 60. A chain or chains 66 can be included to extend from the posts 64 that extend from the first and second legs 58 and 60 of the securing portion 40. The surface element platform 32 can also be included with a plurality of D-rings 68 that can be used to move and position the surface element platform 32.

Figure 5A:
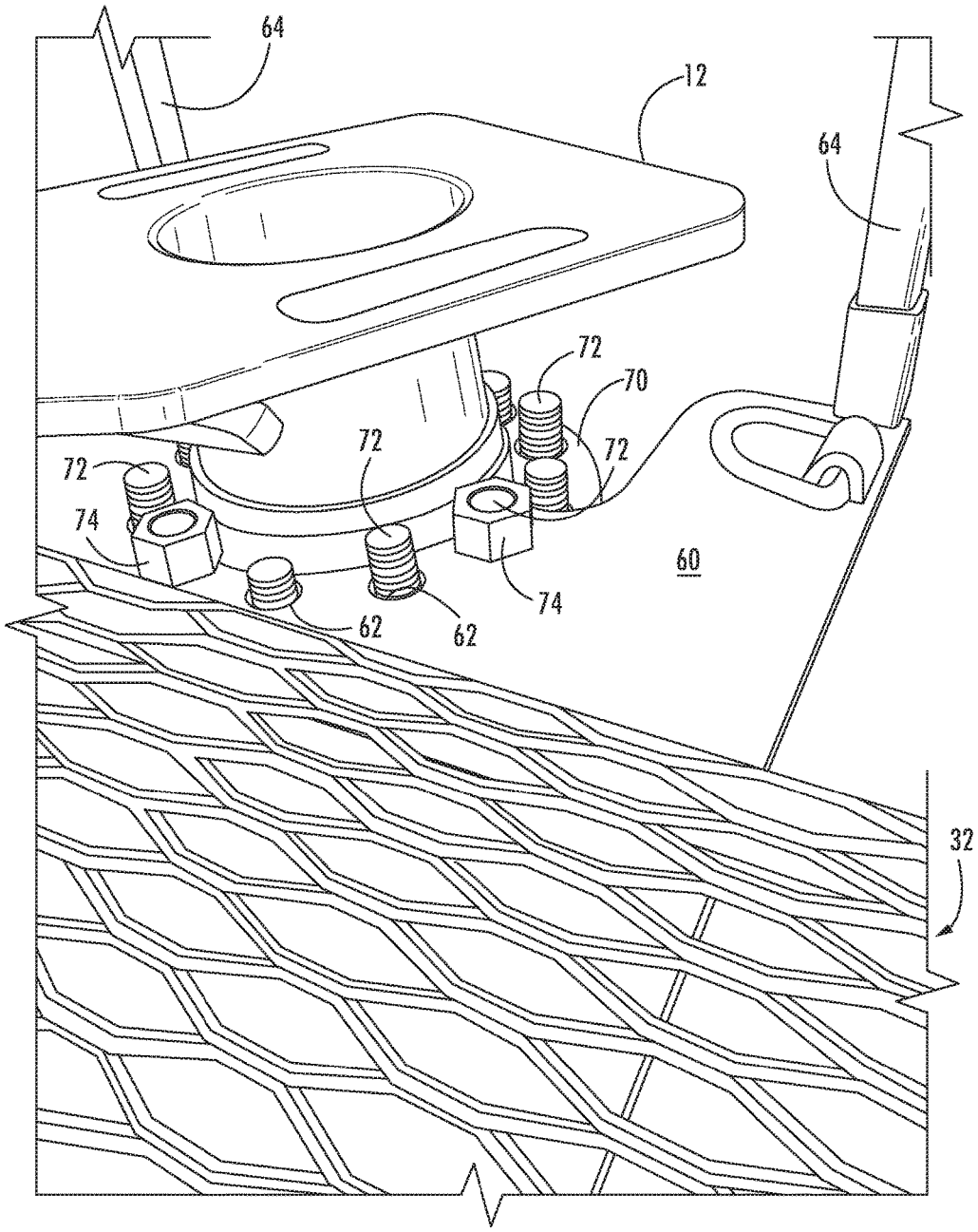
FIG. 5A is a perspective view of a portion of the surface element platform constructed in accordance with the present disclosure.
Figure 5B:
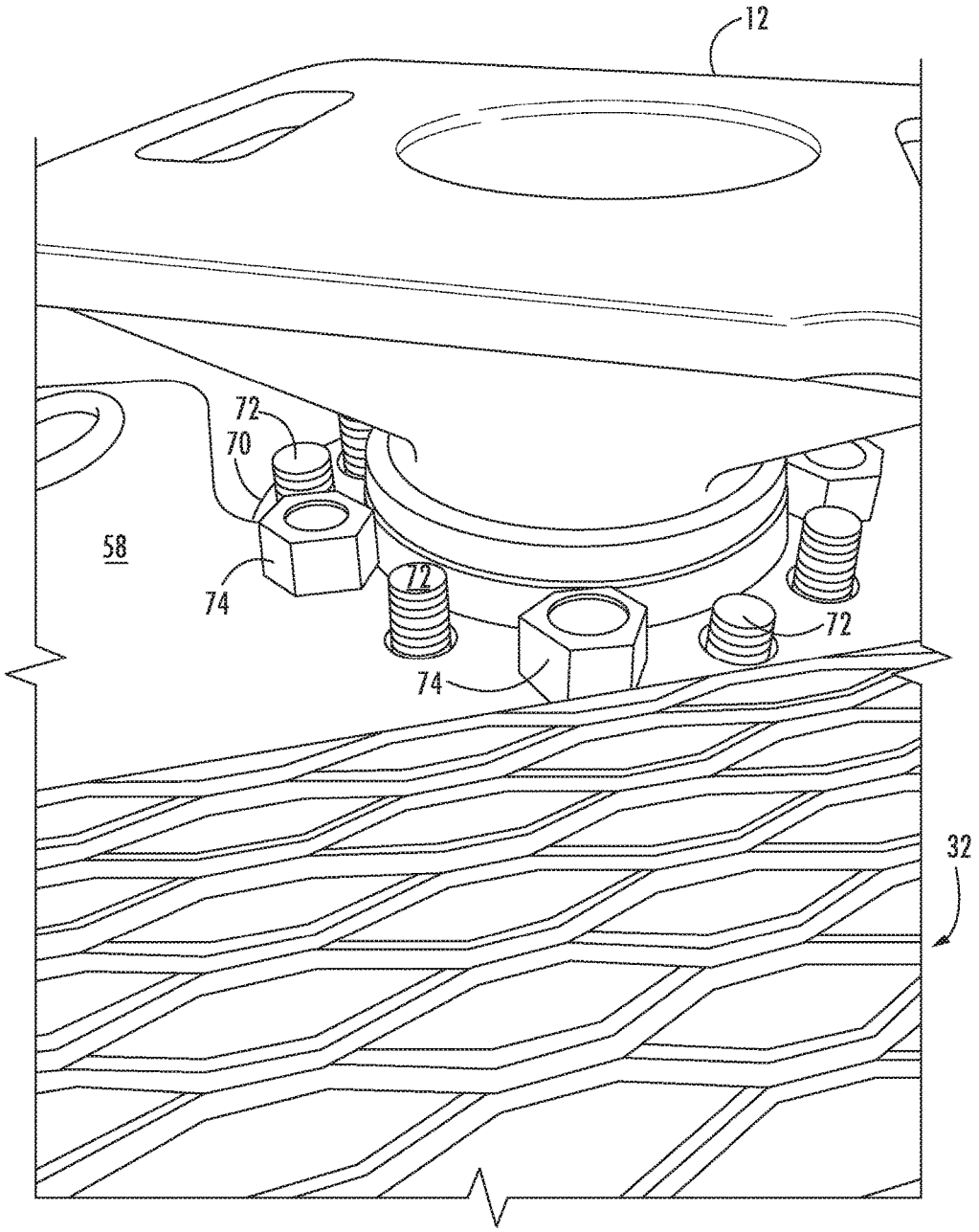
FIG. 5B is a perspective view of another portion of the surface element platform constructed in accordance with the present disclosure.

Referring now to FIGS. 5A and 5B, the surface element 12 can have a flange portion 70 with bolts 72 extending therethrough. The openings 62 of the securing portion 40 of the surface element platform 32 can be placed over the bolts 72 and nuts 74 can engage the bolts 72 to secure the surface element platform 32 to the surface element 12.

In one embodiment, the surface element platform 32 can have an opening disposed therein that permits the production tubing 20 and the cable 24 secured to the production tubing 20 to pass therethrough. It should be understood and appreciated that the surface element platform 32 can be any surface capable of supporting an operator 34 and positioning the operator 34 close enough to the surface element 12 to be able to access the production tubing 20 being withdrawn from the well 10.

Primarily, during oil and gas operations that have production tubing 20 with a cable 24 secured thereto, the oil rig 18 includes the oil rig platform 16 whereby the surface element platform 32 can be positioned below the oil rig platform 16. The cable 24 can be the electric power cable discussed herein for ESPs, a data cable, or a capillary string. Positioning the surface element platform 32 beneath the oil rig platform 16 permits the operator 34 access to the production tubing 20 and the cable 24 to unsecure the cable 24 from the production tubing 20 prior to the production tubing 20 being pulled up through the opening 26 disposed in the oil rig platform 16. Unsecuring the cable 24 from the production tubing 20 can involve cutting the securing devices 28 that secure the cable 24 to the production tubing 20.

The production tubing 20, free from the cable 24, can then be fed through a scanning device 76, which is typically mounted to the oil rig platform 16, to determine if there are any defects in the production tubing 20. The scanning device 76 can be any device capable of scanning the production tubing 20, such as any type of electronic scanning device, a 3D scanning device, or a gamma ray scanning device.

The cable 24 that is separated from the production tubing 20 can be fed through a secondary opening 78 in the oil rig platform 16 and, ultimately, to a spool 80 that collects the cable 24. The platform apparatus 30 can also include a guide 82 that can contact the cable 24 and put it in a better position to travel through the secondary opening 78 in the oil rig platform 16 and be more efficiently spooled.

A method of unsecuring the cable 24 from the production tubing 20 as it is withdrawn from the well 10 is also provided herein. As the production tubing 20 and the cable 24 are withdrawn from the well 10, the operator 34, positioned on the surface element platform 32, unsecures the cable 24 from the production tubing 20 and feeds the cable 24 to the spool 80. The production tubing 20 is permitted to continue to pass through the opening 26 in the oil rig platform 16 and be scanned by the scanning device 76 without the cable 24 secured thereto. The cable 24 can be unsecured from the production tubing 20 by cutting the securing devices 28 that secure the cable 24 to the production tubing 20. In one embodiment, the operator 34 uses some type of cutting device to cut the securing devices 28 and directs the cable 24 to the secondary opening 78 in the oil rig platform 16.

The present disclosure also contemplates being able to use the scanning device 76 to scan production tubing 20 on a pole unit 84. A pole unit does not have a platform to secure the scanning device 76 to. In this embodiment, the surface element platform 32 can be positioned such that the opening in the surface element platform 32 is above the surface element 12 and the scanning device 76 is supported by the surface element platform 32 so production tubing 20 being removed by the pole unit can be scanned. The surface element platform 32 can be supported by the surface element 12 or it can be attached to the surface element platform 32.

Figure 6:
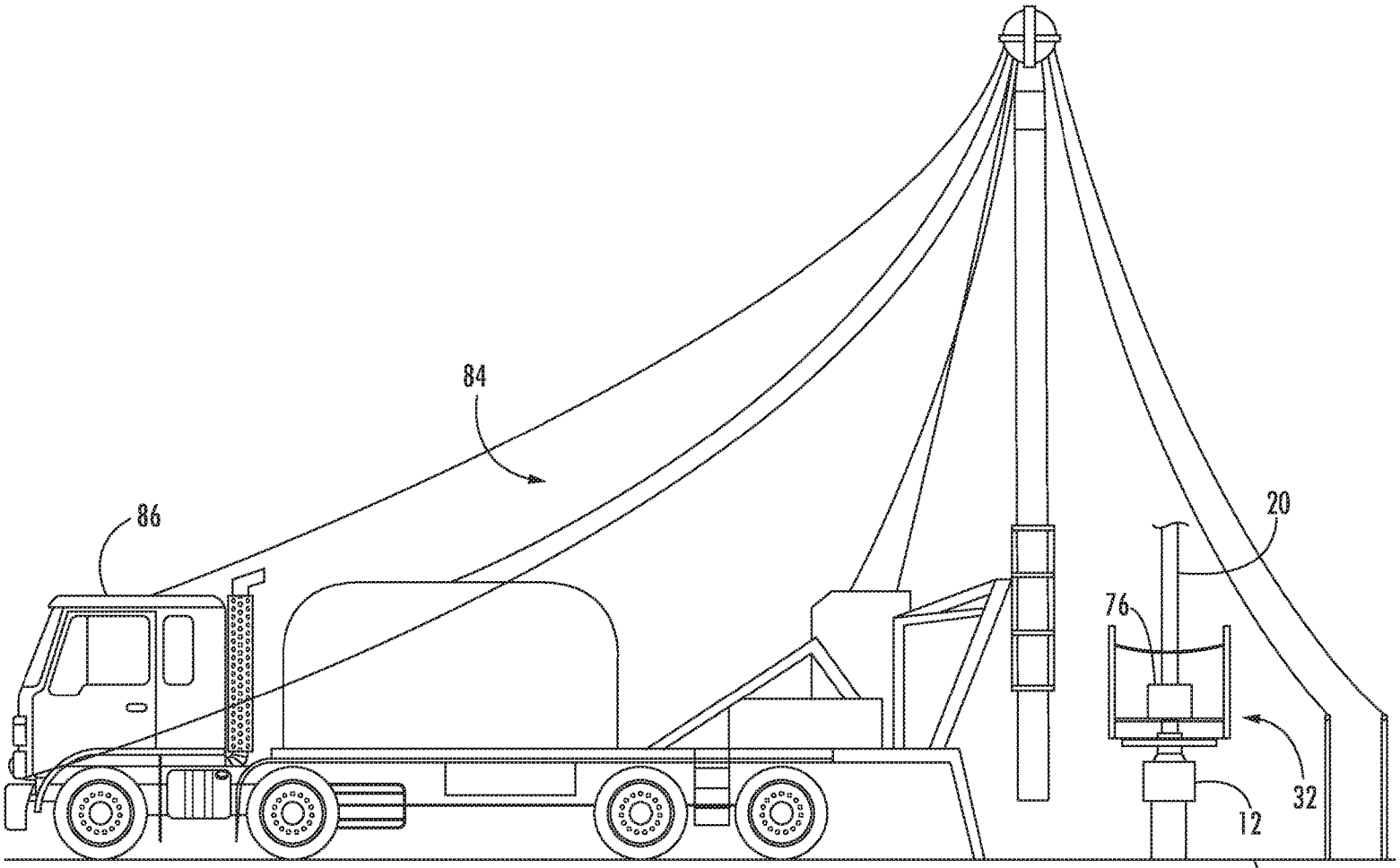
FIG. 6 is a side elevation view of the surface element platform in use with a pole unit.

Referring now to FIG. 6, the surface element platform 32 can be used with the pole unit 84, which is an oil and gas apparatus attached to a vehicle 86 and used when an oil rig is not used. Typically, pole units 84 do not incorporate any platform for working with the production tubing 20 being withdrawn from the well 10. In this embodiment, the surface element platform 32 is used to hold the scanning device 76 in position to scan the production tubing 20 as production tubing 20 is being withdrawn from the well 10. The surface element platform 32 can be used with respect to the surface element 12 in oil and gas operations using the pole unit 84 as previously described herein for use with traditional oil rig platforms.

From the above description, it is clear that the present disclosure is well adapted to carry out the objectives and to attain the advantages mentioned herein as well as those inherent in the disclosure. While presently preferred embodiments have been described herein, it will be understood that numerous changes may be made which will readily suggest themselves to those skilled in the art and which are accomplished within the spirit of the disclosure and claims.

What is claimed is:

1. A method, the method comprising:

positioning a platform apparatus in close proximity to a blowout preventer or a wellhead of a well to permit an operator access to production tubing and cable secured to the production tubing;

separating the cable from the production tubing;

feeding the cable through a secondary opening in a primary oil rig platform after the cable has been separated from the production tubing; and scanning the production tubing with an electronic scanning device after the cable has been separated from the production tubing as the production tubing is being removed from the well.

2. The method of claim 1 wherein the cable is separated from the production tubing by cutting a securing device that secures the cable to the production tubing.

3. The method of claim 1 wherein the platform apparatus is supported by the blowout preventer or the wellhead.

4. The method of claim 1 wherein the platform apparatus is secured to the blowout preventer or the wellhead.

5. The method of claim 4 wherein the platform apparatus includes openings for receiving bolts of the blowout preventer or a wellhead and securing the platform apparatus to the blowout preventer or the wellhead.

6. The method of claim 1 wherein the platform apparatus includes a u-shaped plate extending from a platform portion, the u-shaped plate secured to the blowout preventer or the wellhead.

7. The method of claim 1 wherein the platform apparatus is disposed beneath a primary oil rig platform apparatus.

8. A method, the method comprising:

positioning a platform apparatus in close proximity to a blowout preventer or a wellhead of a well being serviced by a pole unit to permit an operator access to production tubing, the platform apparatus includes openings for receiving bolts of the blowout preventer or the wellhead and securing the platform apparatus to the blowout preventer or the wellhead; and scanning the production tubing with an electronic scanning device as the production tubing is being removed from the well.

9. The method of claim 8 further comprising the step of supporting the electronic scanning device with the platform apparatus so the scanning device can surround the production tubing as it is withdrawn from the well.

10. The method of claim 9 wherein the platform apparatus includes a u-shaped plate extending from a platform portion, the u-shaped plate secured to the blowout preventer or the wellhead.

11. A method, the method comprising:

positioning a platform apparatus in close proximity to a blowout preventer or a wellhead of a well to permit an operator access to production tubing and cable secured to the production tubing, wherein the platform apparatus is supported by the blowout preventer or the wellhead;

separating the cable from the production tubing; and scanning the production tubing with an electronic scanning device after the cable has been separated from the production tubing as the production tubing is being removed from the well.

12. The method of claim 11 further comprising the step of feeding the cable through a secondary opening in a primary oil rig platform after the cable has been separated from the production tubing.

13. The method of claim 11 wherein the cable is separated from the production tubing by cutting a securing device that secures the cable to the production tubing.

14. The method of claim 11 wherein the platform apparatus is secured to the blowout preventer or the wellhead.

15. The method of claim 14 wherein the platform apparatus includes openings for receiving bolts of the blowout preventer or a wellhead and securing the platform apparatus to the blowout preventer or the wellhead.

16. The method of claim 11 wherein the platform apparatus includes a u-shaped plate extending from a platform portion, the u-shaped plate secured to the blowout preventer or the wellhead.

17. The method of claim 11 wherein the platform apparatus is disposed beneath a primary oil rig platform apparatus.

* * * * *